US007246926B2

(12) United States Patent
Harwood

(10) Patent No.: US 7,246,926 B2
(45) Date of Patent: Jul. 24, 2007

(54) COLOR CHANGING LIGHT FIXTURE

(76) Inventor: Ronald P. Harwood, 31110 Applewood, Farmington Hills, MI (US) 48331

( * ) Notice: Subject to any disclaimer, the term of this patent is extended or adjusted under 35 U.S.C. 154(b) by 14 days.

(21) Appl. No.: 11/060,122

(22) Filed: Feb. 17, 2005

(65) Prior Publication Data

US 2005/0254241 A1 Nov. 17, 2005

Related U.S. Application Data

(60) Provisional application No. 60/569,911, filed on May 11, 2004.

(51) Int. Cl.
*F21V 15/00* (2006.01)

(52) U.S. Cl. ..... 362/365; 362/371; 362/364; 362/372; 362/250; 362/234

(58) Field of Classification Search ..... 362/364, 362/365, 366, 370, 371, 372, 234, 250, 648, 362/231
See application file for complete search history.

(56) References Cited

U.S. PATENT DOCUMENTS 5,702,177 A * 12/1997 Lin ..... 362/648
6,231,205 B1 * 5/2001 Slesinger et al. ..... 362/133
6,554,458 B1 * 4/2003 Benghozi ..... 362/365
6,860,624 B2 * 3/2005 Hille et al. ..... 362/427
6,860,628 B2 * 3/2005 Robertson et al. ..... 362/555
7,014,336 B1 * 3/2006 Ducharme et al. ..... 362/231
2005/0122742 A1 * 6/2005 Ho ..... 362/615

* cited by examiner

*Primary Examiner*—Sandra O'Shea
*Assistant Examiner*—Zahra I. Bennett
(74) *Attorney, Agent, or Firm*—Marshall & Melhorn LLC

(57) ABSTRACT

A color changing light fixture is provided for producing indirect self-illuminating effects within the fixture, which comprises a housing or reflector having an indirect light source and, optionally, a primary light source mounted within. The fixture's self-illuminating effects are conducive to adding to the design scheme of a room or an area being lighted. The fixture may be recessed, surface mounted, suspended, or wall mounted. The indirect light source, which is powered by a low voltage power source, includes one or more light emitting diode (LED) strips that may be fixed or adjustable, and includes the capability of being completely or partially concealed within the fixture. The LEDs can provide a plurality of visible colors (including white), which can be mixed by any number of control devices, like music and video mixers, and door opening and occupancy sensors.

20 Claims, 4 Drawing Sheets

COLOR CHANGING LIGHT FIXTURE

RELATED APPLICATIONS

This application claims the benefit, under 35 U.S.C. § 119(e), of pending U.S. Provisional Patent Application Ser. No. 60/569,911, filed May 11, 2004 under 35 U.S.C. § 111(b), which application is co-pending as of the date of the filing of this application, and which is incorporated herein, in its entirety by reference.

BACKGROUND OF THE INVENTION

The present invention relates to lighting. More particularly, the present invention relates to lighting fixtures. Most particularly, the present invention relates to a low voltage, lighting fixture having an indirect light source mounted within a housing and forming a part of the lighting fixture.

Indirect lighting is known in the lighting industry. In one form, such indirect lighting usually involves a source of light mounted below a ceiling, being aimed at the ceiling and being diffusely reflected by the ceiling. Indirect lighting of walls and displays are also known, in which a light source mounted some distance from the wall or display is aimed so as to diffusely reflect light on to the wall or display.

In another form of indirect lighting, it has been known that light can be bounced off of reflectors in a manner that light is redistributed out of a housing and off of a reflector into a space. Both methods typically depend upon high light energy sources to provide sufficient usable light.

Because generally the light from an indirect source is white light, or full spectrum light wherein the color rendering is pleasant, most, if not all, indirect source luminaries have used incandescent, high intensity discharge, such as metal halide or fluorescent.

This invention teaches the practice of illuminating a housing for the purpose of creating an effect. That is that the housing or internal reflector is meant to absorb color as well as "white" light in a manner that only illuminates the housing or internal parts of the fixture. For this purpose, low energy LED light sources, configured with red, blue and green LED's can provide white and a full spectrum of colors in a manner that uses extremely low electric energy, but provides the effect of indirect light emission without filling the room with colored light.

This technique can utilize a number of control devices to mix any desired color. It can include an electronic or digital means of control that is connected to a music or video source, or any other source of visible or audible nature, trigger upon door opening, occupancy sensors and the like. This technique has the potential of engaging the fixture housing as colorful addition to a room interior without changing the color of the room.

When used in conjunction with a direct light source, such as a low voltage rail, the effect is unique in that the fixture housing becomes a colorful backdrop for the rail and lamp sources. This technique eliminates the need for color filters either of a subtractive or additive nature, and can also provide varied effects in an adjustable version either attached to the low voltage rail or utilized by itself in an adjustable fashion.

There is also known in the lighting industry a growing demand for smaller and more flexible light fixtures. There is also an increasing demand for lighting fixtures to be concealed or semi-concealed. However, the necessity, until the present invention, of surface mounting indirect lighting fixtures conflicted with the desire to have smaller, more flexible lighting fixtures. Thus, a search for smaller, more flexible, indirect lighting fixtures has continued in the art.

SUMMARY OF THE INVENTION

The present invention solves the aforementioned problems in the lighting art by combining a recessed lighting fixture housing with a source of low voltage indirect light. The term "indirect" in the present application is used to mean aimed into a housing, i.e., at the sides or top of the housing, and not out of the housing at a surface being illuminated. By recessing the indirect light source in the housing, and making the indirect light source either fixed or adjustable, the indirect light source can be completely or partially concealed within the housing.

The present invention provides a unique method of installation and unique lighting methods previously not achievable in a reasonable manner. The invention couples a housing of any material with one, or more, low voltage LED strips (generally meaning 24 volts or less) that may or may not be adjustable along the vertical axis, and may or may not be parallel to the sides of the housing. The LED strip(s) may be of a single color. The LED strip(s) may also be of a multi-color, such as red-blue-green. Some of both types may be used, if desired. Either type of LED strip may be controlled by a mixing device to produce a desired color that may be white.

The present invention allows for a fully or partially recessed LED strip that may or may not be adjusted to allow the indirect light source or LED strip to be concealed above, or "flush", with the vertical sides of the housing. Said housing can be installed within a ceiling or wall cavity, or suspended in space. The housing may be of a parallelepiped (square or rectangular), or substantially parallelepiped (square or rectangular with rounded edges) shape. A circular housing, or any other desired shaped housing may also be used. Generally, in contrast to the known recessed light housings, the bottom of the housing will be open. However, there may be a translucent panel forming the bottom of the housing if desired.

In addition to the housing, there can be a reflector installed just below the top or roof of the housing to increase the efficiency of the present invention. This reflector will help bounce the indirect light from the indirect light source out of the housing. A dimmer may be utilized to control the light intensity.

The housing may or may not contain a low voltage power supply. There may be one or a plurality of the indirect or secondary light sources.

It is to be understood that the present invention is not limited to the details of construction and arrangements of parts illustrated in the accompanying drawings, since the present invention is capable of other embodiments and of being practiced or carried out in various ways within the scope of the claims. Also, it is to be understood that the phraseology and terminology employed herein is for the purpose of description only, and not of limitation.

DETAILED DESCRIPTION OF THE PREFERRED EMBODIMENTS

Figure 1:
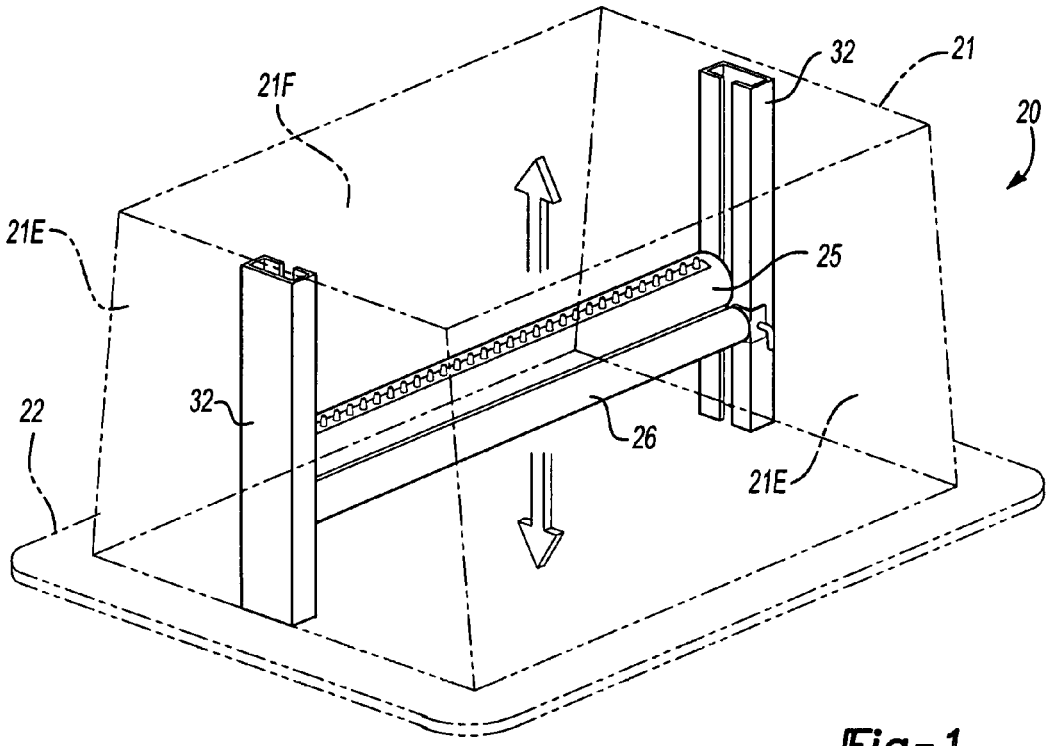
FIG. 1 is a perspective view of a construction embodying the present invention.

Referring to FIG. 1, there is illustrated a recessed, indirect, low voltage lighting fixture embodying the present invention, and generally designated by the numeral 20. The lighting fixture 20 comprises a housing 21 having four interior side surfaces 21E and an interior top surface 21F, which may be made of any practical material, and may have a flange and/or trim ring and/or bezel 22, which will fill in the gaps between the housing 21 and the ceiling, wall, or other location in which the light fixture 20 is installed.

One or more LED strips 25, which are well known in the art, are mounted to a mounting beam or member 26. It is known in the art that LED strips come in many colors, and in multi-colors (i.e., one strip can contain, for example, blue, green and red LED's). If a color changing light fixture is desired, multiple single color LED strips can be mounted to the mounting beam or member 26, and electrical circuitry 50, 60, 70, (see FIG. 7-9) well within the skill of those in the lighting art, will be provided to provide for a desired one of the multiple single color LED strips to illuminate, when desired. Alternately, a single, multi-colored, LED strip may be provided, with the accompanying circuitry, to have only the desired color of the multi-colors illuminate, which may be white light. Such circuitry may, or may not, be contained within the housing 21. A low voltage transformer/power source 30 (FIGS. 6-9) may be provided at the housing 21 if desired, or remote from the housing.

It is a discovery of the present invention that when low energy light that radiates from the LED strips 25 is only directed to the interior surfaces of the sides 21E and/or top 21F, then the present invention creates the effect of indirect light emission without filling the room with colored light, which only illuminates the housing or internal parts of the fixture.

Figure 2:
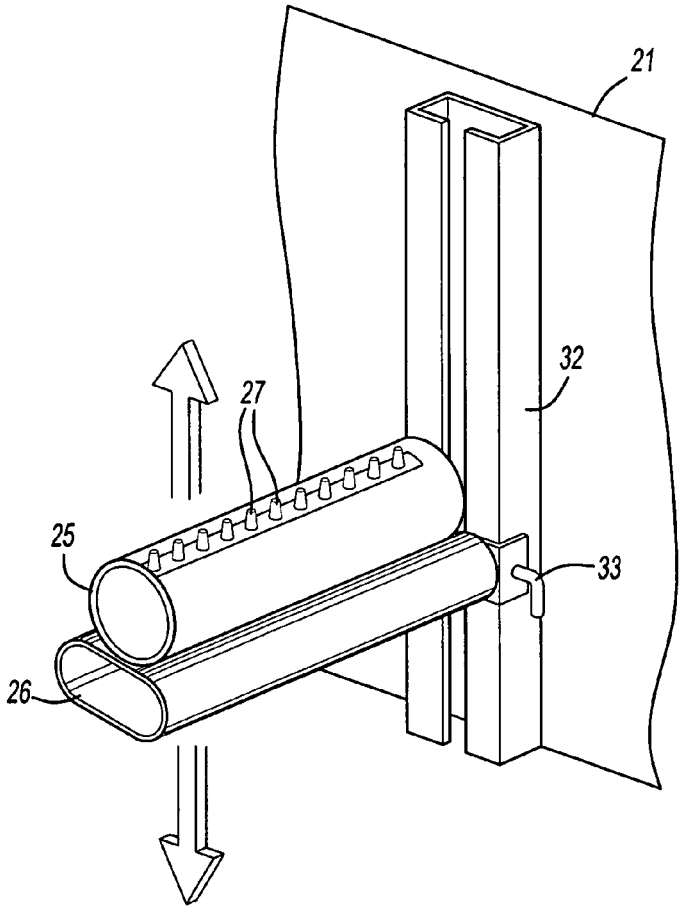
FIG. 2 is an enlarged view of the construction shown in FIG. 1, partially broken away, showing the adjustability feature of the indirect light source.
Figure 3:
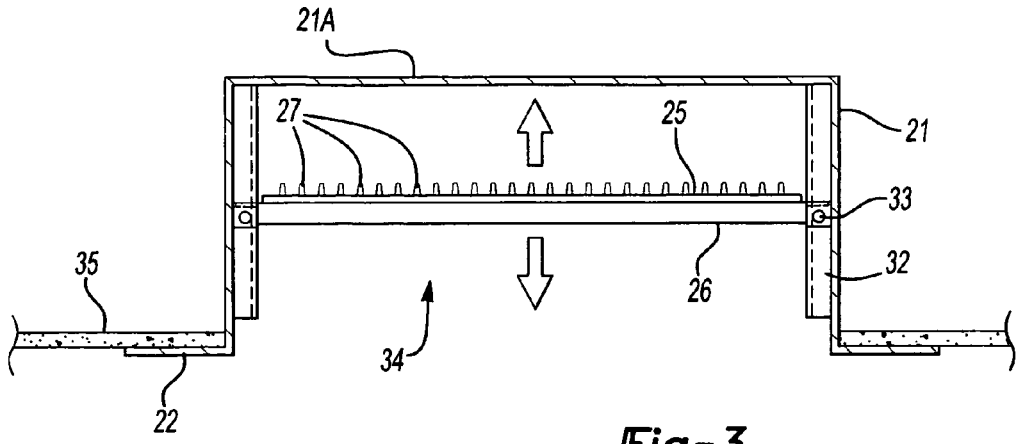
FIG. 3 is an elevational sectional view of the construction shown in FIG. 1.

Referring now to FIGS. 2 and 3, the mounting beam or member 26 carrying LED strip 25, having a plurality of LED's 27, is adjustably mounted within the housing 21, by means of brackets 32 and adjustment means 33. Mounting beam or member 26, brackets 32, and adjustment means 33, may be of any suitable type, all of which are well known in the art.

The LED strip 25 is electrically connected to the low voltage power source or supply 30 (FIG. 6) by means well known in the art. The power supply 30 may or may not be mounted on the housing 21 and may or may not, be remotely controlled. The LED strip 25, and/or, the mounting member or beam 26 may or may not be parallel to the side of the housing 21, or the roof or the top of the housing 21A. The housing 21 is shown recessed into an opening or aperture in a ceiling 35. It is well within the scope of the present invention to recess the housing 21 into a wall or other surface if desired.

Figure 4:
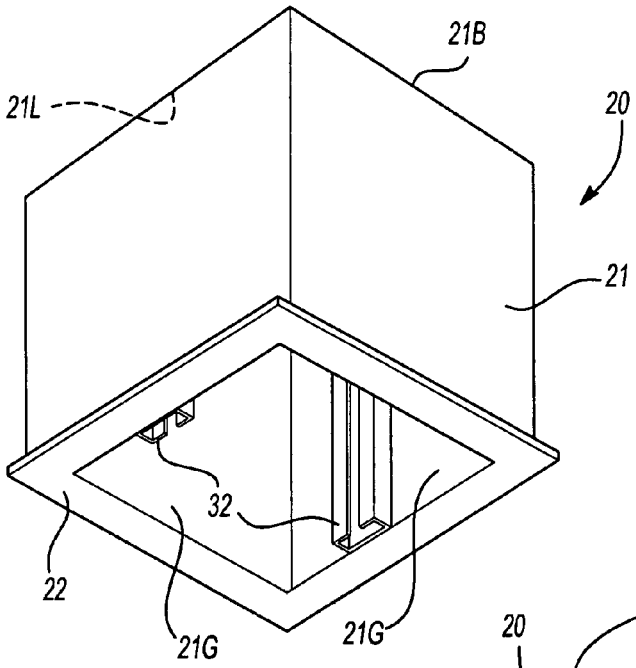
FIG. 4 is a perspective view of a modification of the present invention.
Figure 5:
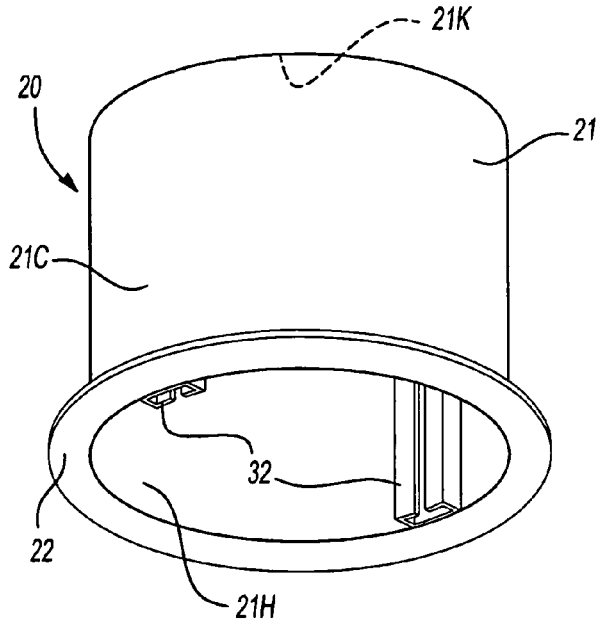
FIG. 5 is a perspective view of a further modification of the present invention.
Figure 5A:
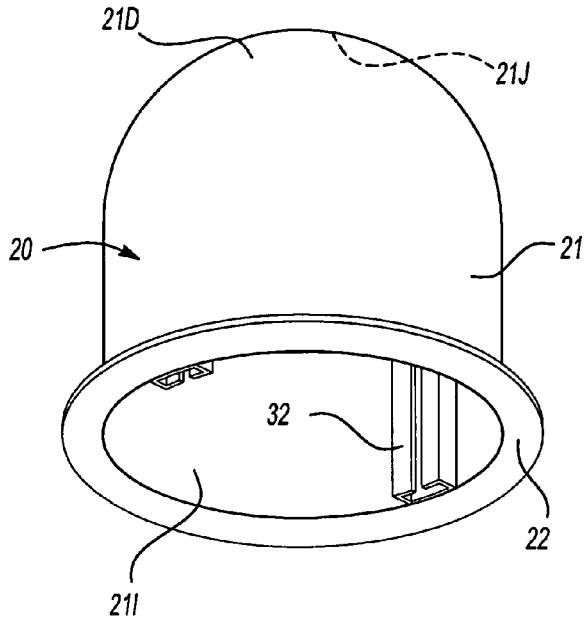
FIG. 5A is a perspective view of another further modification of the present invention.

With reference to FIGS. 4-5A, it can be seen that the housing 21 may be many shapes, such a square housing 21B, which has an interior side surfaces 21G and an interior top surface 21L, a circular housing 21C, which has an interior side surface 21H and an interior top surface 21K, or domed top housing 21D, which has an interior side surface 21I and an interior top surface 21J.

It is a discovery of the present invention that when low energy light that radiates from the LED strips 25 is only directed to the interior surfaces of the sides 21G, 21H, 21I and/or top 21L, 21K, 21J, then the present invention creates the effect of indirect light emission without filling the room with colored light.

Figure 6:
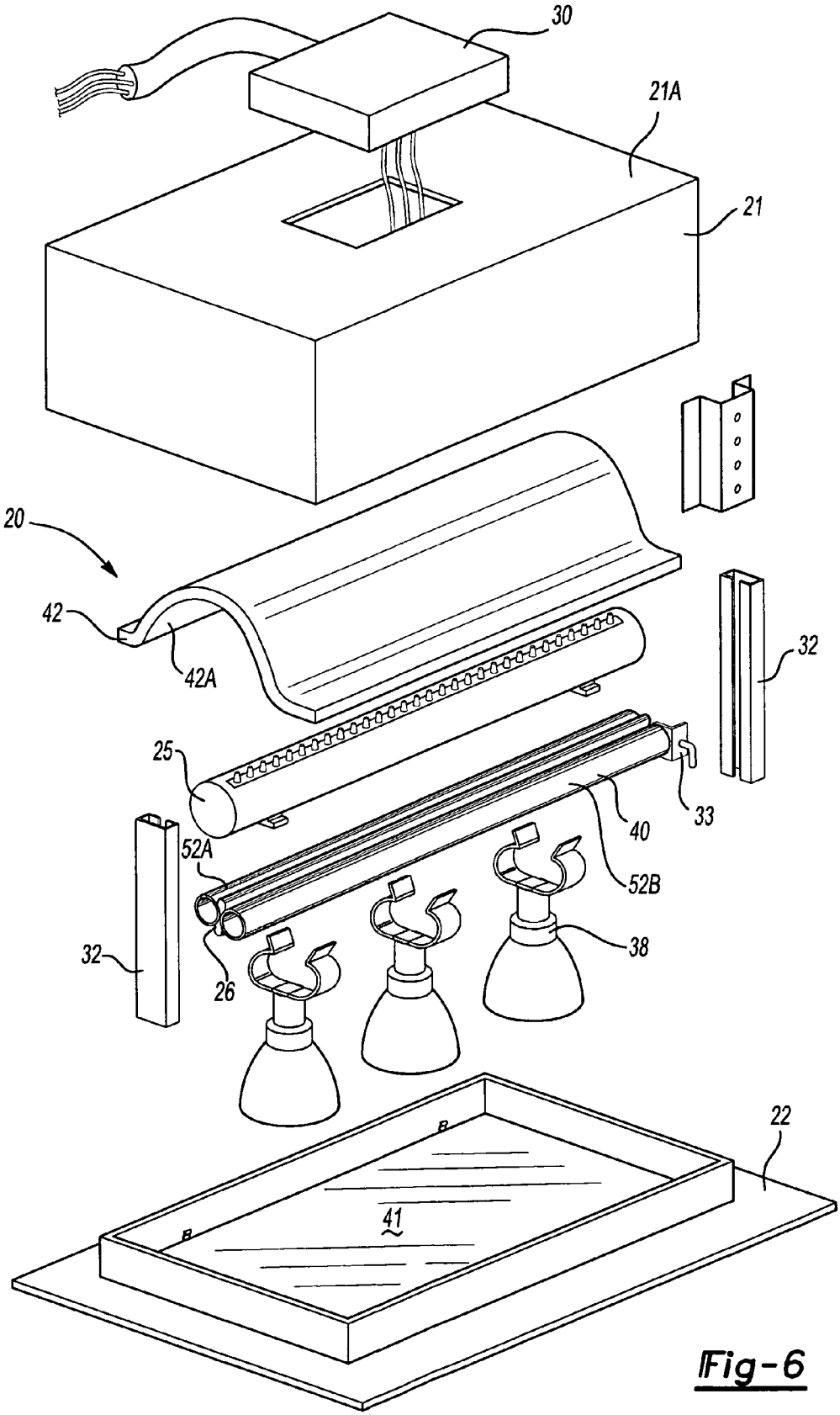
FIG. 6 is an exploded perspective view of a further modification of the present invention.

Referring to FIG. 6, in some lighting applications it is thought to be desirable to combine a source of indirect lighting as defined above with a source of direct lighting. It is preferable that, when combined, both the source of indirect lighting, such as the LED strip 25, having a plurality of LED's 27, and the source of direct lighting, such as the light fixture 38, be low voltage, which is generally 12 to 24 volts.

In this embodiment of the present invention, a low voltage lighting rail 40, which may be such as manufactured by Bruck Lighting of Costa Mesa, Calif., is adjustably mounted within the housing 21 by means of brackets 32 and adjustment means 33, and may also serve as mounting beam 26. The lighting rail 40 is electrically connected to a low voltage power supply 30 by means well known in the art. The power supply may or may not be mounted on the housing 21, and may or may not be remotely controlled. The lighting rail 40 may or may not be parallel to the side of the housing 21, or the roof or the top of the housing 21A.

Mounted to the lighting rail 40 may be one or more adjustable light fixtures 38, which may be such as the Model No. V/A Calo II 35/51 manufactured by Bruck Lighting of Costa Mesa, Calif., or any other of a number of such fixtures well known in the art.

Preferably the lighting rail 40 extends linearly, and the one or more adjustable fixtures 38 are adjustable along the full length of the lighting rail 40. Preferably, the lighting rail should be at least 10 to 12 inches long. A reflector 42, which has an interior top surface 42A, may be mounted or placed inside the housing 21 to help reflect light out of the housing. Although the reflector 42 is shown with the fixture of FIG. 6, it well within the spirit and scope of the present invention that the reflector 42 may be utilized by any of the embodiments of the present invention.

The single or multiple LED strips 25 are now mounted to the top of the low voltage lighting rail 40, which now serves as the mounting beam or member 26, thus providing a novel and unique combination recessed low voltage direct and indirect lighting fixture, which may be color changing, if desired.

Also shown in FIG. 6 is an optional translucent panel 41 forming the bottom of the housing. The translucent panel 41 may be constructed of glass, plastic, or other suitable material that will pass light, which may be attached to the lighting fixture 20, housing 21, and/or bezel 22 by means common in the art, like screws, rivets, snaps, being molded in place, and/or gravity, to mention a few. Although the translucent panel 41 is shown with the fixture of FIG. 6, it well within the spirit and scope of the present invention that the translucent panel 41 may be utilized by any of the embodiments of the present invention.

Figure 7:
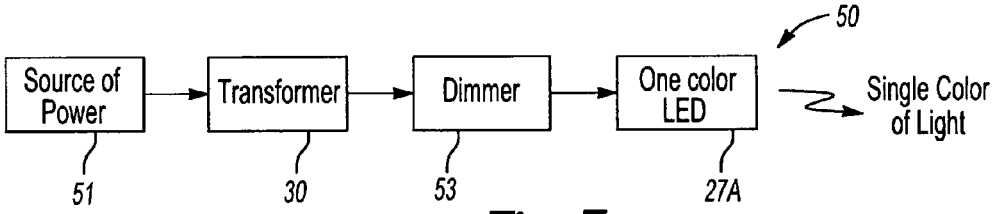
FIG. 7 is a schematic wiring diagram showing how power may be supplied to a construction embodying the present invention.

Referring now to FIG. 7 there is shown a first wiring diagram, generally designated by the numeral 50, where a source of power 51 is in electrical communication with the transformer/power supply 30. The source of power 51 would be in the nominal range of 120-240 VAC and the transformer/power supply 30 would supply the low voltage of, for example, 12-24 volts. In turn, the transformer/power supply 30 would be utilized to communicate the low voltage to a one color LED 27A that is in electrical communication with low voltage tracks 52A and 52B that are located on the lighting rail 40, within the lighting fixture 20. The instant invention, however, is not limited by the range of the incoming voltage, by the low voltage output, or the LED that is utilized.

Also shown in FIG. 7 is an optional dimmer 53 that is common in the art, which is used to manually or automatically control the magnitude of the low voltage supplied to the low voltage track 40, by the transformer/power supply 30. Thus, the dimmer 53 effectively controls the intensity of the single color LED light, which may be white, that is supplied by the one color LED 27A of the lighting fixture 29. However, the present invention is not limited by the one color LED 27A utilized, the use of the dimmer 53, or by the type of the dimmer 53 utilized in the wiring diagram 50.

Figure 8:
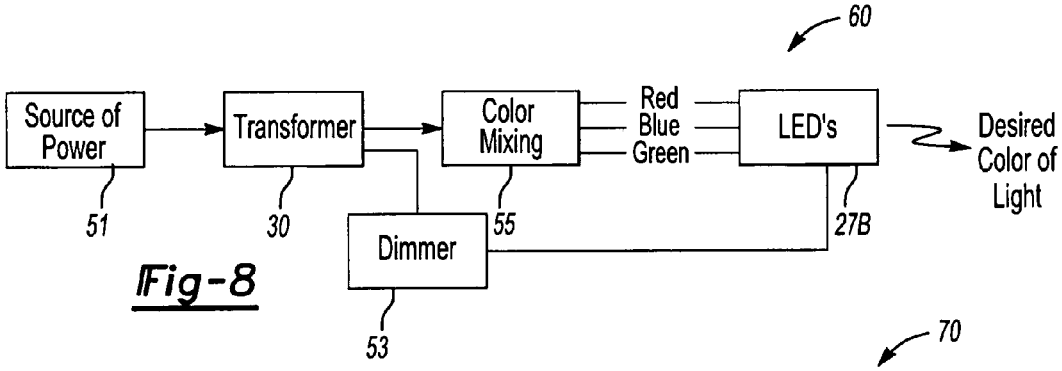
FIG. 8 is a schematic wiring diagram showing how power may be supplied to a modification of a construction of the present invention.

FIG. 8 illustrates a second wiring diagram, generally designated by the numeral 60, where the source of power 51 is in electrical communication with the transformer/power supply 30. The transformer/power supply 30 would be utilized to communicate the low voltage to a control or color mixing device 55 that electrically communicates a desired mix of red-blue-green signals to a set of color LEDs 27B that are electrically connected within the lighting fixture 20, thus providing a desired output color of light, which may be white. The instant invention, however, is not limited by the color LEDs 27B, the control or color mixing device 55, which may be manually or automatically operated, or by the LEDs that are utilized.

Also shown in FIG. 8 is the optional dimmer 53, which is used to manually or automatically control the magnitude of the low voltage supplied to the low voltage track 40, by the transformer/power supply 30, thus effectively controlling the intensity of the multicolor LED light that is supplied by the lighting fixture 20.

Figure 9:
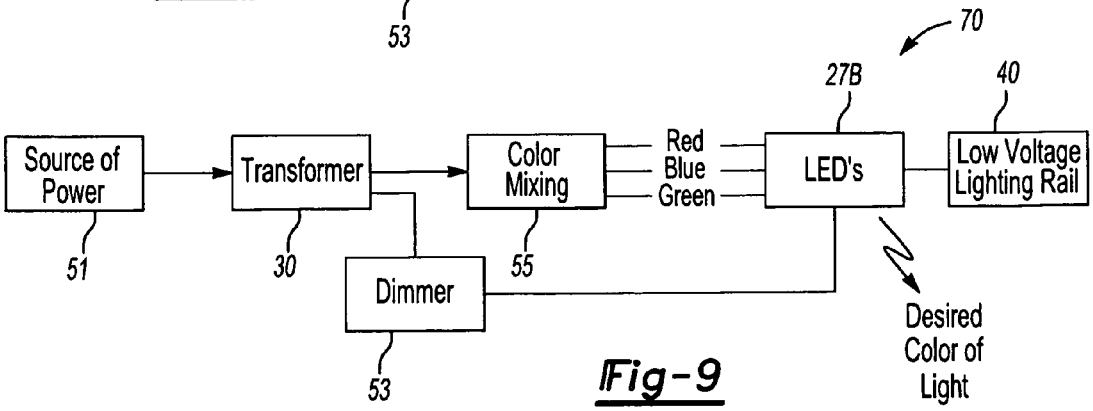
FIG. 9 is a schematic wiring diagram showing how power may be supplied to a further modification of the present invention.

FIG. 9 shows a third wiring diagram, generally designated by the numeral 70, that is essentially the second wiring diagram 60 of FIG. 8, wherein FIG. 9 further shows the electrical connection between the LEDs 27B and the low voltage rail 40. In this configuration, the low voltage rail 40 is shown to be available to power other low voltage electrical components, for example, light fixtures 38 and possible other non-lighting, low voltage electrical components (not shown).

There may also be a power connection between the transformer/power supply 30 and the lighting rail 40, if desired. Many different electrical circuits may be developed to operate the present invention, and are well within the scope thereof.

In accordance with the provisions of the patent statutes, the principles and modes of operation of this invention have been described and illustrated in its preferred embodiments. However, it must be understood that the invention may be practiced otherwise than specifically explained and illustrated without departing from its spirit or scope.

What is claimed is:

1. A color changing light fixture, comprising:

a housing or reflector having at least a side wall and a top wall, the the at least a sidewall and a top wall each having an interior surface;

vertical brackets mounted in the housing;

a mounting beam or member adjustably mounted within the housing or reflector for slideable movement in the vertical brackets; and a low energy light source capable of radiating a single color, which includes white, or a plurality of colors, mounted to the mounting beam or member;

wherein light radiated by the low energy light source is directed to the interior surfaces of the at least a sidewall and a top wall.

2. The color changing light fixture of claim 1, wherein the light fixture is capable of recessed mounting.

3. The color changing light fixture of claim 1, wherein the light fixture can be concealed in a wall or ceiling cavity, or can be suspended in space.

4. The color changing light fixture of claim 1, wherein the housing is a square or rectangular parallelepiped, a substantially square or rectangular parallelepiped where the edges are rounded, or a circular shaped housing.

5. The color changing light fixture of claim 1, wherein the top is dome shaped.

6. The color changing light fixture of claim 1, wherein the low energy light source is powered by a power supply or transformer that is attached to the fixture.

7. The color changing light fixture of claim 1, wherein the low energy light source is powered by approximately 24 volts or less.

8. The color changing light fixture of claim 1, wherein the low energy light source comprises at least one light emitting diode strip.

9. The color changing light fixture of claim 1, further comprising a translucent panel forming the bottom of the fixture.

10. The color changing light fixture of claim 1, further comprising a control device for controlling the color radiated by the low energy light source.

11. The color changing light fixture of claim 10, wherein the control device comprises an audio mixer, video mixer, door opening sensor, or occupancy sensor that electrically cooperates with the low energy light source to vary the color radiated by the low energy light source.

12. The color changing light fixture of claim 1, wherein the low energy light source electrically cooperates with a dimmer for manually or automatically controlling a magnitude of the intensity of the low energy light source.

13. The color changing light fixture of claim 1, further comprising at least one direct lighting source.

14. The color changing light fixture of claim 13, wherein a low voltage rail, which has a low voltage power track disposed within, is the mounting beam or member that is adjustably mounted to the fixture, wherein the direct lighting source is adjustably mounted to the low voltage rail, and the low energy light source and the direct lighting source are electrically connected to the low voltage track.

15. The color changing light fixture of claim 1, further comprising a power supply or transformer that is remotely controlled.

16. A color changing light fixture, comprising:

a housing having at least one side and a top, the sides and the top each having an interior surface;

at least one light emitting diode strip capable of producing a single color, which includes white, or a plurality of colors, the light emitting diode strip being adjustably mounted to a low voltage rail within the fixture, the low voltage rail having a low voltage track therein and the low voltage rail being adjustably mounted to the housing;

at least one direct lighting source that is adjustably mounted to the low voltage rail, the direct lighting source and the light emitting diode strip being electrically connected to the low voltage track, the low voltage track being electrically powered by approximately 24 volts or less; and wherein light radiated by the light emitting diode strip is only directed to the interior surfaces of the sides and the top.

17. The color changing light fixture of claim 16, further comprising at least one reflector, the reflector attached to the interior of the housing for reflecting the light radiated from within the housing.

18. The color changing light fixture of claim 17, further comprising a control device that electrically cooperates with the light emitting diode strip to control the color radiated by the light emitting diode strip, wherein the control device comprises an audio mixer, video mixer, door opening sensor, or occupancy sensor.

19. A method of lighting an area using the color changing lighting fixture of claim 16, comprising:

radiating light of a single color, including white, or a plurality of colors, from a low energy light source which directs light upwardly onto an interior reflective surface of a light housing.

20. The method of lighting an area of claim 19, further comprising:

radiating light from a direct lighting source through the bottom of the light housing, thus directly lighting the area away from the bottom of the housing.

* * * * *